US009771249B2

(12) United States Patent
Scott

(10) Patent No.: US 9,771,249 B2
(45) Date of Patent: Sep. 26, 2017

(54) SPORTING VEHICLE LIFT

(71) Applicant: William E. Scott, Fort Collins, CO (US)

(72) Inventor: William E. Scott, Fort Collins, CO (US)

( * ) Notice: Subject to any disclaimer, the term of this patent is extended or adjusted under 35 U.S.C. 154(b) by 174 days.

(21) Appl. No.: 14/693,775

(22) Filed: Apr. 22, 2015

(65) Prior Publication Data

US 2016/0311669 A1 Oct. 27, 2016

(51) Int. Cl.

| | |
|---|---|
| ***B66F 7/00*** | (2006.01) |
| ***B66F 7/02*** | (2006.01) |
| ***B66F 7/22*** | (2006.01) |
| ***B66F 7/28*** | (2006.01) |

(52) U.S. Cl.

CPC ..... *B66F 7/025* (2013.01); *B66F 7/22* (2013.01); *B66F 7/28* (2013.01)

(58) Field of Classification Search

CPC ..... B66F 7/16; B66F 7/12; B66F 7/14; B66F 7/10; B66F 7/22

USPC ..... 414/678; 187/214

See application file for complete search history.

(56) References Cited

U.S. PATENT DOCUMENTS 3,395,813 A * 8/1968 Bruce ..... B21C 47/24 414/719
3,750,899 A * 8/1973 Greer ..... B66F 7/04 187/213
4,490,085 A * 12/1984 Adami nee Michelini ..... B66F 7/22 187/206
4,506,866 A * 3/1985 Horn ..... B66F 7/04 187/208
4,804,066 A * 2/1989 Fusaro ..... E04H 6/065 187/210
5,015,146 A * 5/1991 Barnes et al. ..... B66F 7/22 187/221
5,281,077 A * 1/1994 Phillips ..... B66F 7/02 187/242
5,368,430 A * 11/1994 Lin ..... B66F 7/025 187/406
6,409,153 B1 * 6/2002 Norris ..... B66F 3/24 254/129
6,443,688 B1 * 9/2002 Komdeur ..... B65G 7/08 280/47.12
7,168,904 B1 * 1/2007 Perkins ..... E04H 6/42 187/203
7,771,155 B2 * 8/2010 Thiel ..... B25H 1/0014 187/214
7,861,828 B1 * 1/2011 Shepard ..... B66F 7/0641 187/211

(Continued)

*Primary Examiner* — Anna Momper
*Assistant Examiner* — Lynn Schwenning
(74) *Attorney, Agent, or Firm* — William W. Cochran; Cochran Freund & Young LLC

(57) ABSTRACT

Disclosed is a sporting vehicle lift that lifts a sporting vehicle and allows a car to be placed under the lifted vehicle. Sling arms that move vertically on a lift tower are connected to a lift pan with pivot connector to raise and lower the lift pan with respect to the floor and allow said lift pan to pivot. The lift pan rotates towards the tower by either placing the pivot connectors on the lift pan in a position so that the center of gravity causes the lift pan to rotate towards the tower, or by using a tilt arm, that is connected to the lift pan, which engages a pivot pin on the tower to rotate the lift pan as the lift pan is raised.

14 Claims, 14 Drawing Sheets

(56) References Cited

U.S. PATENT DOCUMENTS

| | | | | |
|---|---|---|---|---|
| 8,777,544 | B1 * | 7/2014 | Carpenter | B65D 85/68<br>414/430 |
| 2007/0237613 | A1 * | 10/2007 | Randers | E04H 6/005<br>414/426 |

* cited by examiner

SPORTING VEHICLE LIFT

BACKGROUND OF THE INVENTION

Sporting vehicles are becoming increasingly more popular with a large variety of demographic groups. Sporting vehicles are used by all age groups from young teenagers to senior citizens. Sporting vehicles are typically considered to be motorcycles, three-wheelers, four-wheelers, snowmobiles, motor bikes and other types of motorized vehicles including various types of ATVs. As such, sporting vehicles have become more and more common in a large number of households.

SUMMARY OF THE INVENTION

An embodiment of the present invention may therefore comprise a method of storing a sporting vehicle on a lift above a car comprising: placing the sporting vehicle on a lift pan; providing a tower that is connected to tower legs that extend on a floor under the lift pan and function as a cantilever to assist in supporting the tower in an upright position; attaching the lift pan to sling arms using pivot pins that allow the lift pan to rotate with respect to the sling arms; raising the sling arms and the lift pan so that the lift pan can rotate on the pivot pins; engaging the lift pan with the sling arms to limit the amount the lift pan can rotate on the pivot pins, so that the lift pan rotates to an angle that substantially matches the profile of the car.

An embodiment of the present invention may further comprise a sporting vehicle lift for raising and storing a sporting vehicle above a car comprising: a tower disposed on a floor surface; a sling disposed on the tower having a sling cross bracket and at least two sling arms that extend outwardly from the tower; pivot connectors disposed on each of the sling arms; a threaded shaft disposed in the tower that is coupled to the sling cross bracket; a motor that rotates the threaded shaft which causes the sling to move up and down in the tower; tower legs that extend outwardly from the tower in a direction that is substantially parallel to the sling arms and function as a cantilever to hold the tower in a substantially vertical position; a lift pan that is coupled to the sling arms with pivot connectors, the pivot connectors located on the lift pan so that the lift pan does not automatically pivot towards the tower when the sling is raised since the center of gravity of the sporting vehicle and the lift pan is not between the pivot connectors and the tower; a pivot pin disposed on the tower that engages the lift pan which causes the lift pan to pivot when the lift pan is being raised so that a bottom surface of the lift pan is tilted by an amount that allows the car to fit below the lift pan.

DETAILED DESCRIPTION OF THE EMBODIMENTS

Figure 1:
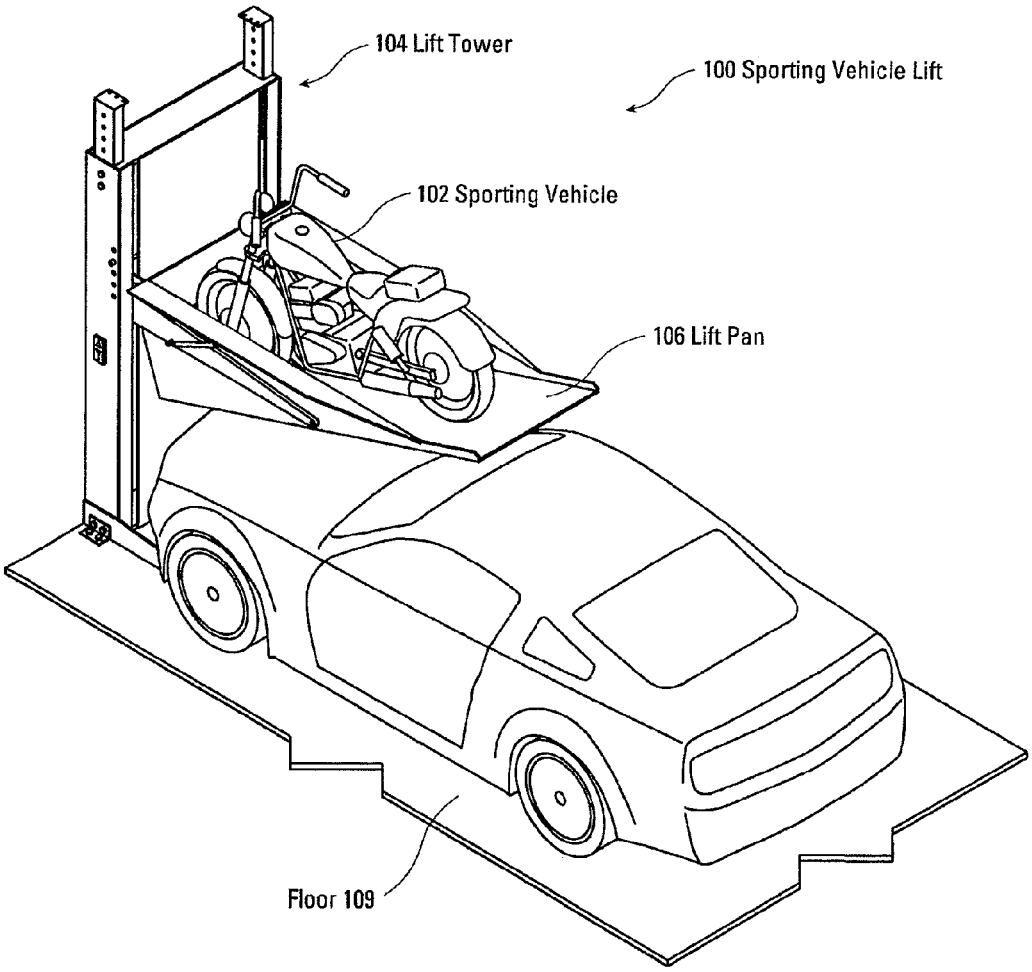
FIG. 1 is an isometric view of an embodiment of a sporting vehicle lift that provides space for a car to park under the lifted sporting vehicle.

FIG. 1 is an isometric view of an embodiment of a sporting vehicle lift 106 in a raised position. As illustrated in FIG. 1, car 108 comprises a standard sedan that can be parked under the sporting vehicle lift 100. This is advantageous in areas where there is limited space such as in a garage with limited space. The owner of the car 108 may also own the sporting vehicle 102 such as a motorcycle or other sporting vehicle, as disclosed above. Rather than leave the motorcycle outside in the weather and potentially in a place where the motorcycle could be vandalized or stolen, the owner can place the motorcycle 102 on the sporting vehicle lift 100 inside a protected area, such as a garage, and simply lift the sporting vehicle 102 on the sporting vehicle lift so that both the sporting vehicle 102 and the car 108 can be parked in the protected area. In other applications, an owner may be located in downtown area and own a loft or downtown apartment. The owner may have purchased a single parking place with the apartment. In addition to car 108, the owner may also own a motorcycle or other sporting vehicle 102 and must have a place to park the sporting vehicle 102. Rather than buying an additional parking place which may cost $50,000 or $100,000, the owner can simply purchase a sporting vehicle lift 100 which allows the owner to park both the car 108 and the sporting vehicle 102 in a single parking spot.

The sporting vehicle lift 100, illustrated in FIG. 1, utilizes a lift tower 104. The sporting vehicle 102 sits on a lift pan 106 and is vertically lifted along the lift tower 104 which allows room for the car 108 to park underneath the lift pan 106 on floor 109.

Figure 2:
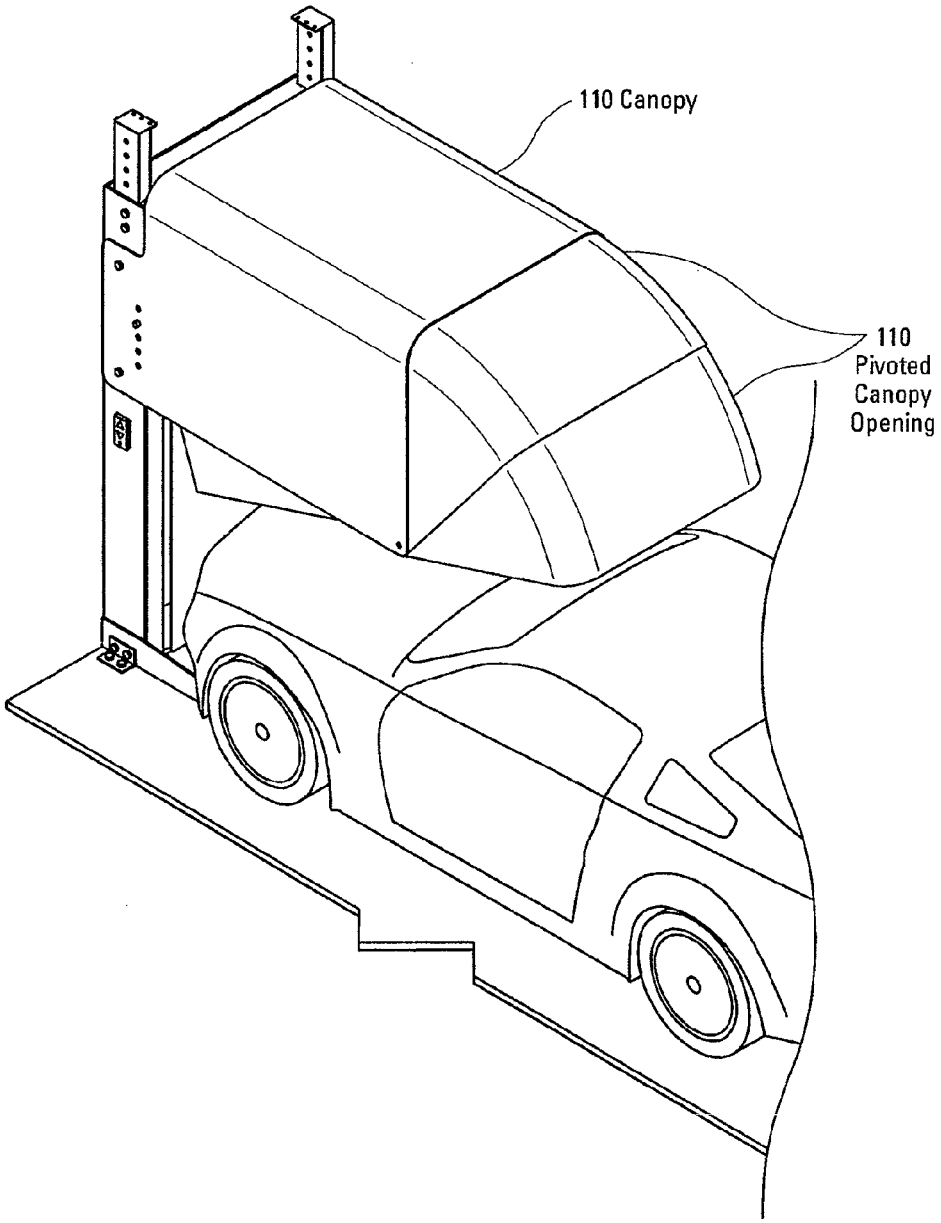
FIG. 2 is an isometric view of an embodiment of the sporting vehicle lift with a lift cover.

FIG. 2 is an isometric view of an embodiment which utilizes a canopy 110. The canopy 110 provides cover for the sporting vehicle in either a lowered position or in the raised position, as illustrated in FIG. 2. The canopy 110 has pivoted canopy openings 111 which enclose the sporting vehicle under the canopy 110. Canopy 110 and pivoted canopy openings 111 may be closely fit with the lift pan 106 to provide a substantially secure enclosure. In that regard, the pivoted canopy openings 111 can be locked to the lift pan 106 to prevent entry to the enclosure and prevent access to the sporting vehicle 102.

Figure 3:
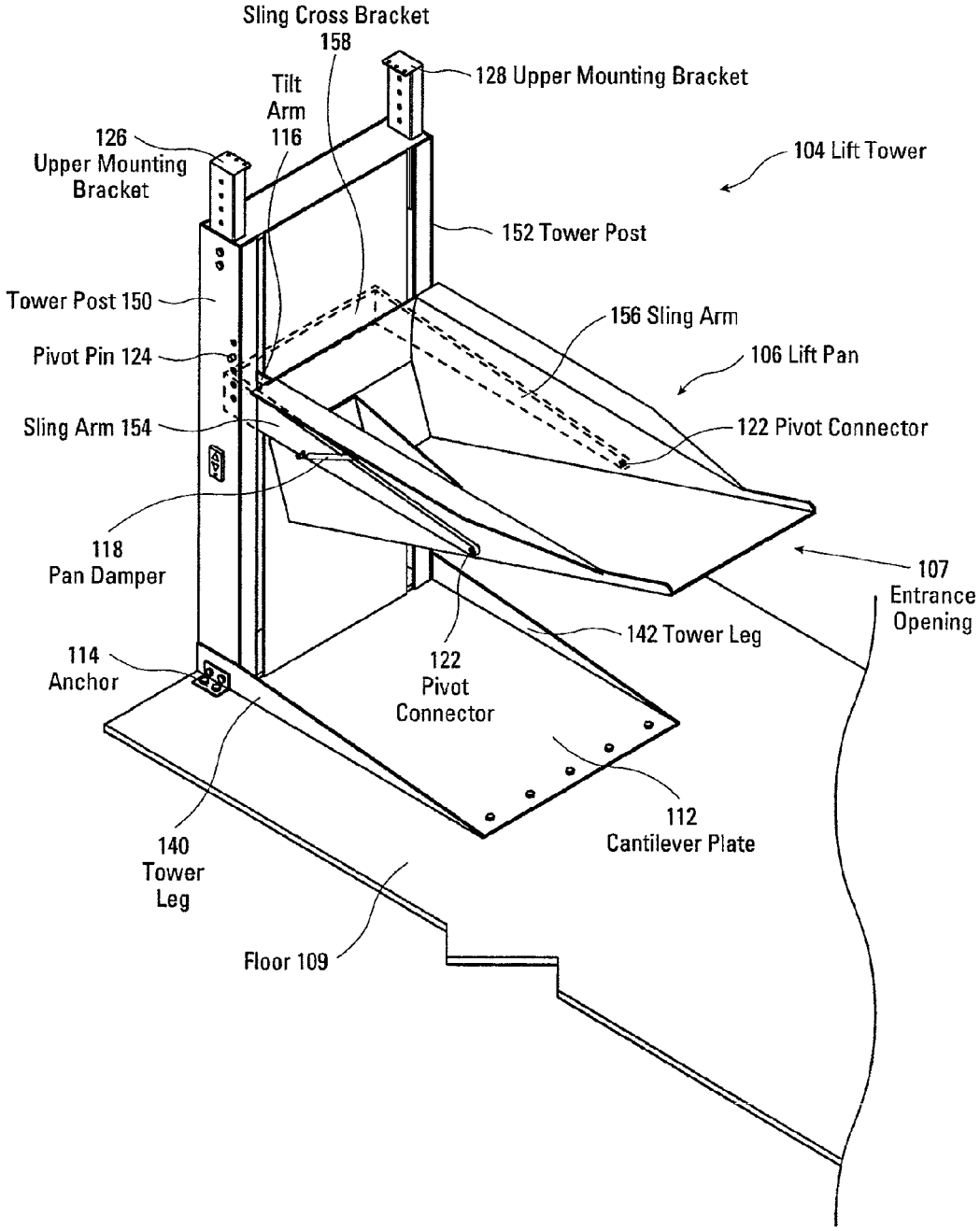
FIG. 3 is another isometric view of the sporting vehicle lift of the embodiment of FIG. 1.

FIG. 3 is another isometric view of the sporting vehicle lift 100 without a sporting vehicle 102. As illustrated in FIG. 3, the lift tower 104 comprises tower posts 150, 152. The tower post 150 is anchored to tower leg 140, while tower post 152 is anchored to tower leg 142. The tower legs 140, 142 are connected to the cantilever plate 112. The cantilever plate 112, as well as the tower legs 140, 142, counteract the forces on the lift tower 104 which would cause the lift tower 104 to topple forward because of the weight on the lift pan 106 from the sporting vehicle 102, and the weight of the lift pan 106. In other words, the tower leg 140 and tower leg 142, together with the cantilever plate 112 function as a cantilever to offset the tilting of weight of the lift pan 106 and the sporting vehicle 102 that is loaded onto the lift pan 106. Anchor 114 and a similar anchor (not shown), anchor the lift tower 104 to the floor 109. The tower 104 may also be anchored, with brackets, such as anchor 114 to a vertical wall. Further, upper mounting brackets 126, 128 may anchor the tower posts 150, 152 to the ceiling of a garage or other structure.

As also illustrated in FIG. 3, the sling that raises and lowers the lift pan 106 comprises sling arm 154, sling arm 156 and sling cross bracket 158. Sling arms 154, 156 are connected to the lift pan 106 at pivot connectors 120, 122, respectively. The location of the pivot connectors 120, 122 on the lift pan 106 is on the entry side of the lift pan 106 from the center of gravity of both the lift pan 106 and the lift pan 106 with the sporting vehicle loaded onto the lift pan 106. In this manner, the lift pan 106 rotates in a counterclockwise direction as illustrated in FIG. 3 when the lift pan 106 is raised from the floor. As the sling is raised, the lift pan 106 tilts forward towards lift tower 104, i.e. to the left as illustrated in FIG. 3. If the sporting vehicle 102 is a long vehicle that stretches nearly to the entrance opening 107, the center of gravity may be to the right of the pivot connectors 120, 122, i.e., towards the entrance opening 107, so that the lift pan 106 is tilted in a clockwise direction towards the entrance opening 107.

It is necessary for the lift pan 106 to be rotated in a counterclockwise direction towards the tower 104 to provide sufficient room for parking the car under the lift pan 106. In that case, tilt arm 116 engages pivot pin 124 as the lift pan 106 is raised, causing the lift pan 106 to rotate on pivot connectors 120, 122 in a counterclockwise direction towards lift tower 104, as illustrated in FIG. 3. In most cases, tilt arm 116 will not need to engage pivot pin 124 since the pivot connectors 120, 122 are placed sufficiently rearwardly, towards the entrance opening 107, to ensure that the center of gravity of the sporting vehicle 102 and the lift pan 106 is forward (i.e., towards the lift tower 104) from the pivot connectors 120, 122. If the combined center of gravity of the sporting vehicle 102 and the lift pan 106 is located slightly rearwardly of the pivot pins 120, 122 (i.e., towards the entrance opening 107) when the lift pan is in a completely lowered position, the combined center of gravity of lift pan 106 and the sporting vehicle 102 may shift forward when the lift pan 106 is rotated by the engagement of the tilt arm 116 and the pivot pin 124, since the center of gravity of the sporting vehicle 102 is vertically displaced from the center of gravity of lift pan 106, in which case, there will be no pressure on pivot pin 124 from tilt arm 116. If the center of gravity does not shift to the forward side (in a direction towards the lift tower 104), the pivot pin will hold the tilt arm 116 so that the lift pan 106 remains rotated in a counterclockwise direction and tilted downwardly towards the lift tower 104.

Figure 4A:
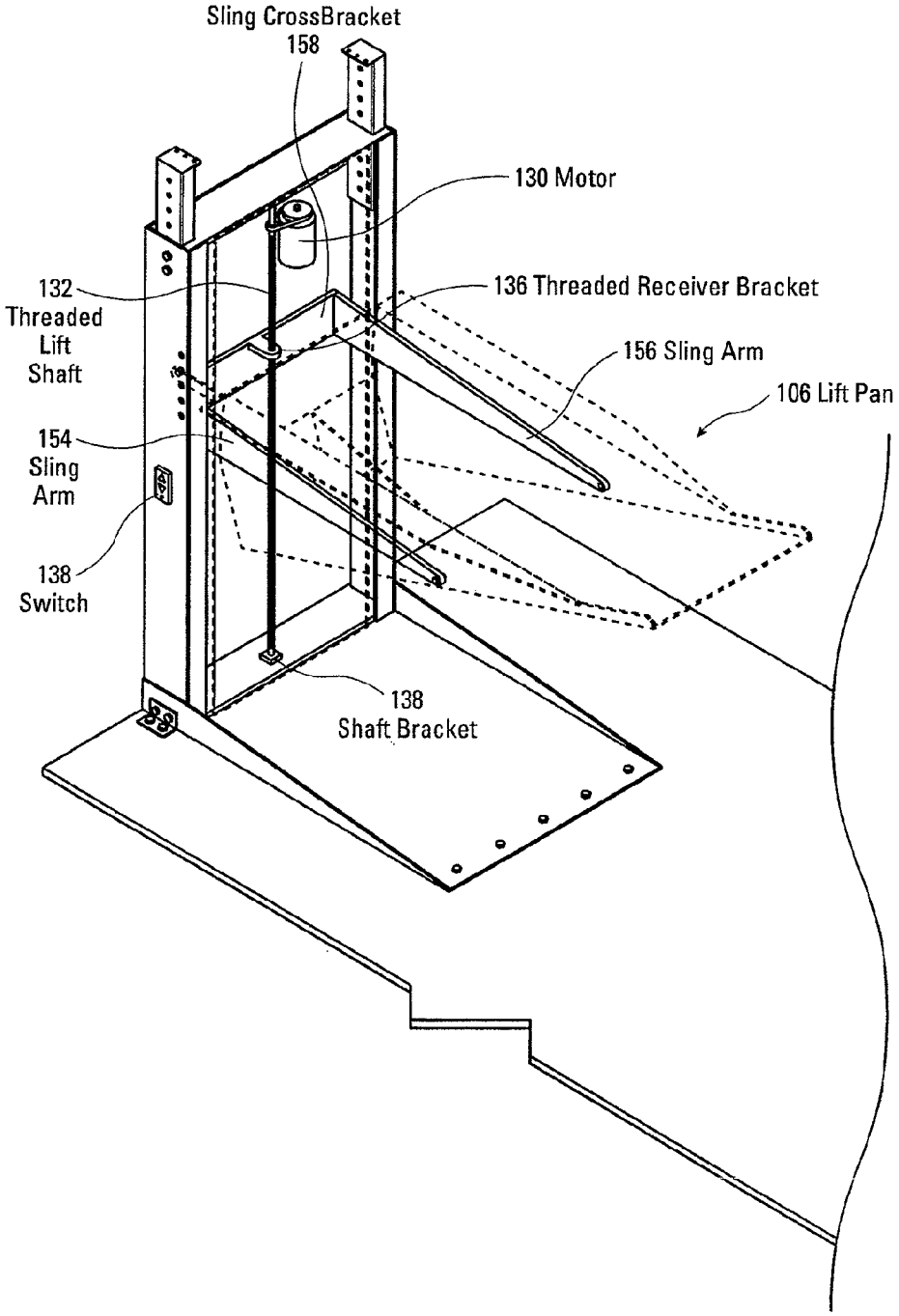
FIG. 4A is another isometric view of an embodiment of the sporting vehicle lift of FIG. 1 with a transparent lift plate and sidewalls.

FIG. 4A is an isometric diagram of the embodiment of FIG. 1 with the lift pan 106 shown in transparency form. As illustrated in FIG. 4A, the sling consists of a sling arm 154, a sling arm 156 and sling cross bracket 158. The sling arms 154, 156 ride in channels in the tower posts 150, 152. The sling cross bracket 158 has a threaded receiver bracket 136 which engages a threaded lift shaft 132. As the threaded lift shaft 132 is rotated, the threaded receiver bracket 136 causes the sling cross bracket 158 and the sling arms 154, 156 to be raised and lowered. Motor 130 is coupled to the threaded lift shaft 132 and causes the threaded lift shaft 132 to rotate. Switch 138, and related controls disposed in switch 138, control the operation of the motor 130. Threaded lift shaft 132 rotates in a shaft bracket 134 has bearings to allow the lift shaft 132 to rotate and be held securely in place at the bottom of the tower.

Figure 4B:
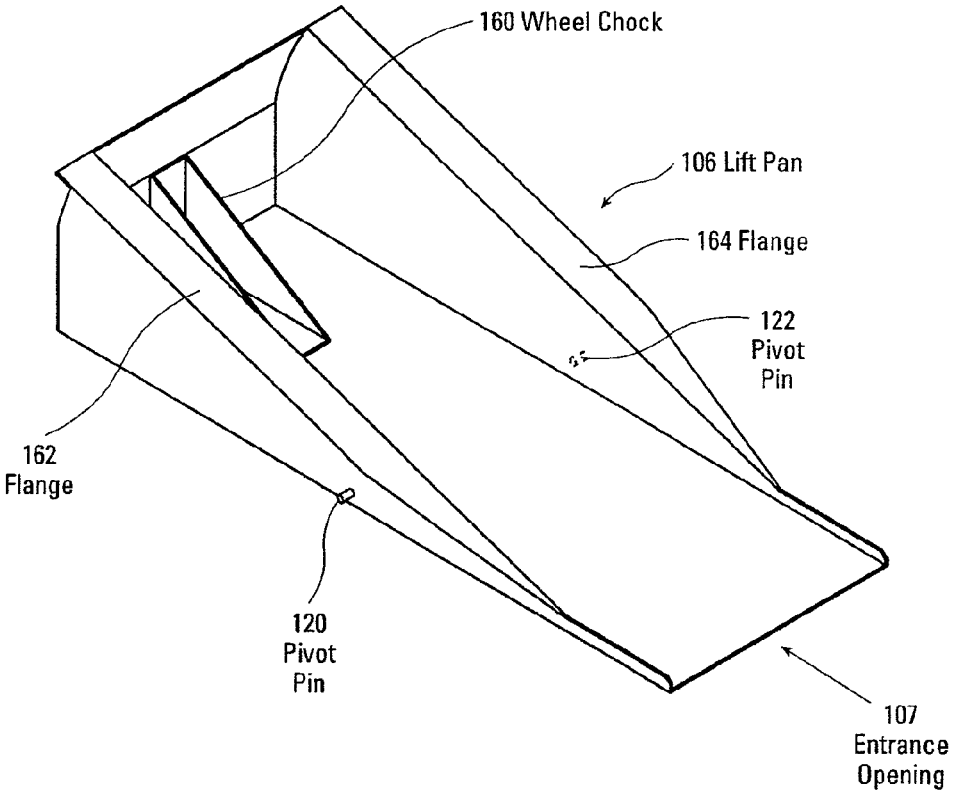
FIG. 4B is an isometric view of an embodiment of a lift pan.

FIG. 4B is an isometric view of the lift pan 106. As shown in this embodiment, the lift pan 106 has a wheel chock 160 for a motorcycle. Of course, other types of chocks or devices can be used to support or hold the sporting vehicle 102 in the lift pan 106. As also illustrated in FIG. 4B, the lift pan 106 has pivot pins 120, 122. The entrance opening 107 provides a ramp to allow the sporting vehicle to be easily loaded onto the lift pan 106. Flanges 162, 164 extend outwardly from the body of the lift pan 106. When the lift pan 106 is mounted in the sling, and the sling arms 154, 156 engage the pivot pins 120, 122, respectively, the lift pan 106 will tilt in a counterclockwise direction, as shown in FIG. 4B, towards the lift tower 104 until the sling arms 154, 156 engage the flanges 162, 164, respectively.

Figure 5:
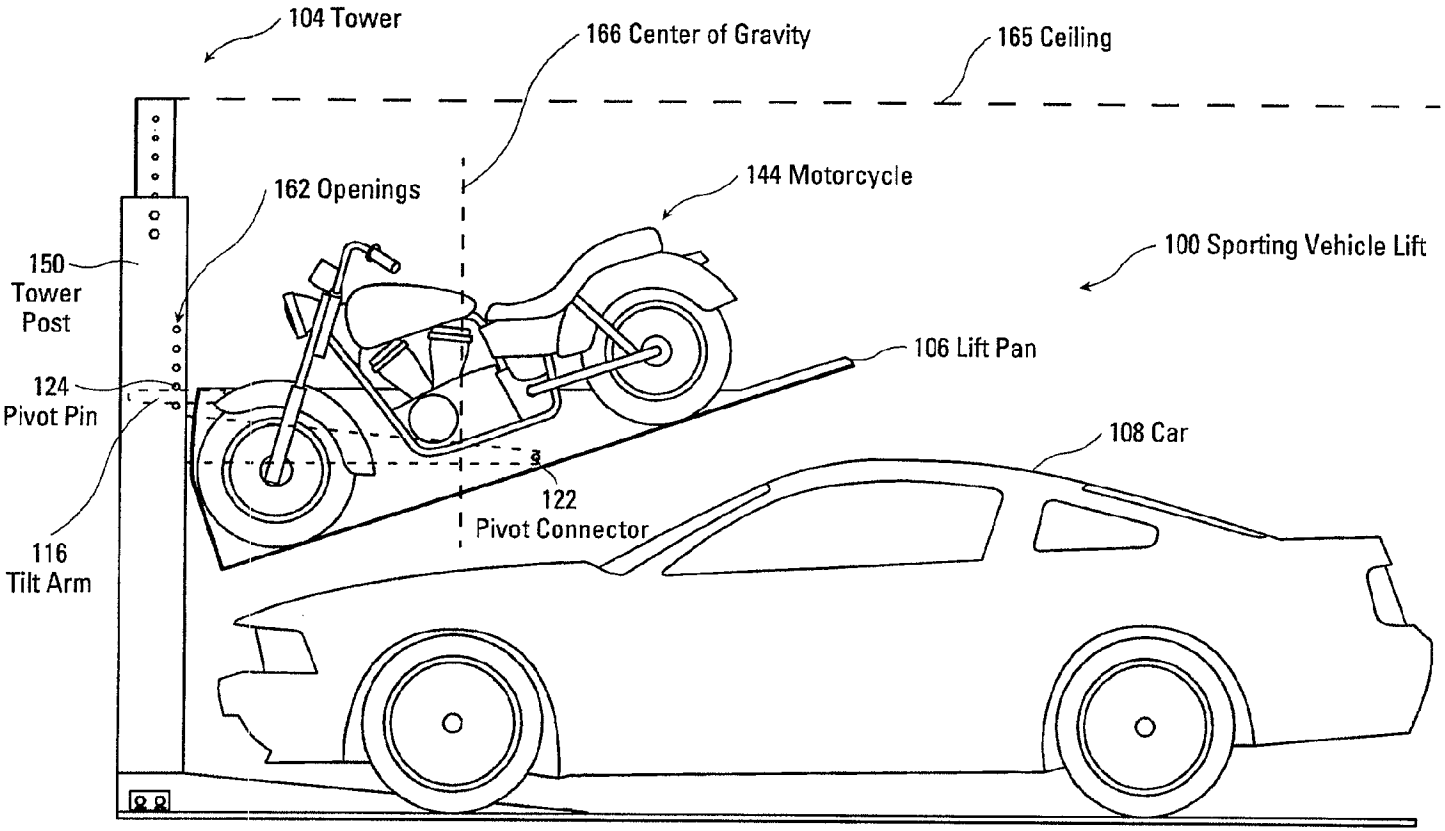
FIG. 5 is a side view of the embodiment of the sporting vehicle lift of FIG. 1 with a motorcycle lifted over a car.

FIG. 5 is a schematic side view of the sporting vehicle lift 100 in a raised position. As shown in FIG. 5, the lift pan 106 is tilted in a forward direction towards the tower post 150. Pivot pin 122 and a similar pivot pin 120 are located rearwardly of the center of gravity 164 of the combined lift pan 106 and motorcycle 144. Tilt arm 116 engages pivot pin 124 to ensure that the lift pan 106 is tilted in a counterclockwise or forward direction towards the tower post 150 when the lift pan is raised. The tilt arm 116 and pivot pin 124 ensure that the lift pan 106 becomes tilted. For example, if motorcycle 144 is a large, long motorcycle, the center of gravity 166 could possibly shift rearwardly, or to the right, of the pivot connector 122 illustrated in FIG. 5. In such a case, the lift pan 106 would not automatically tilt in a counterclockwise direction towards the tower post 150, in which case the tilt arm 116 would engage the pivot pin 124 to ensure that the lift pan 106 rotates in a counterclockwise or forward direction. By rotating the. lift pan 106 in a counterclockwise direction, room is provided for the car 108. As shown in FIG. 5, the height to which the lift pan 106 and motorcycle 104 are lifted is reduced since the bottom of the lift pan 106 is tilted to substantially match the profile of the car 108. For example, if the lift pan 106 was in a horizontal orientation, the lift pan 106 and motorcycle 144 would necessarily have to be elevated to a higher position to clear the car 108. The amount of tilt is determined by the intersection of the flanges 162, 164 with the sling arms 154, 156, respectively. The height of the lift pan 106 between the bottom surface of the lift pan and the flanges 162, 164 therefore determine the amount of tilt of the lift pan 106.

As illustrated in FIG. 5, the sporting vehicle lift 100 provides a compact manner of storing a motorcycle 144 or other sporting vehicle 102 (FIG. 1) in a garage. Many garages or other storage areas have limited height. For example, a standard garage may have an 8 foot ceiling 165. By allowing the lift pan 106 to tilt to at least somewhat match the profile of the front of the car 108, the amount that the lift pan 106 and motorcycle 144 are lifted is reduced to a height which can fit under the ceiling 165 of a standard or low height garage. Again, this is achieved by tilting the lift pan 106 in a forward direction towards the tower 104.

Figure 6:
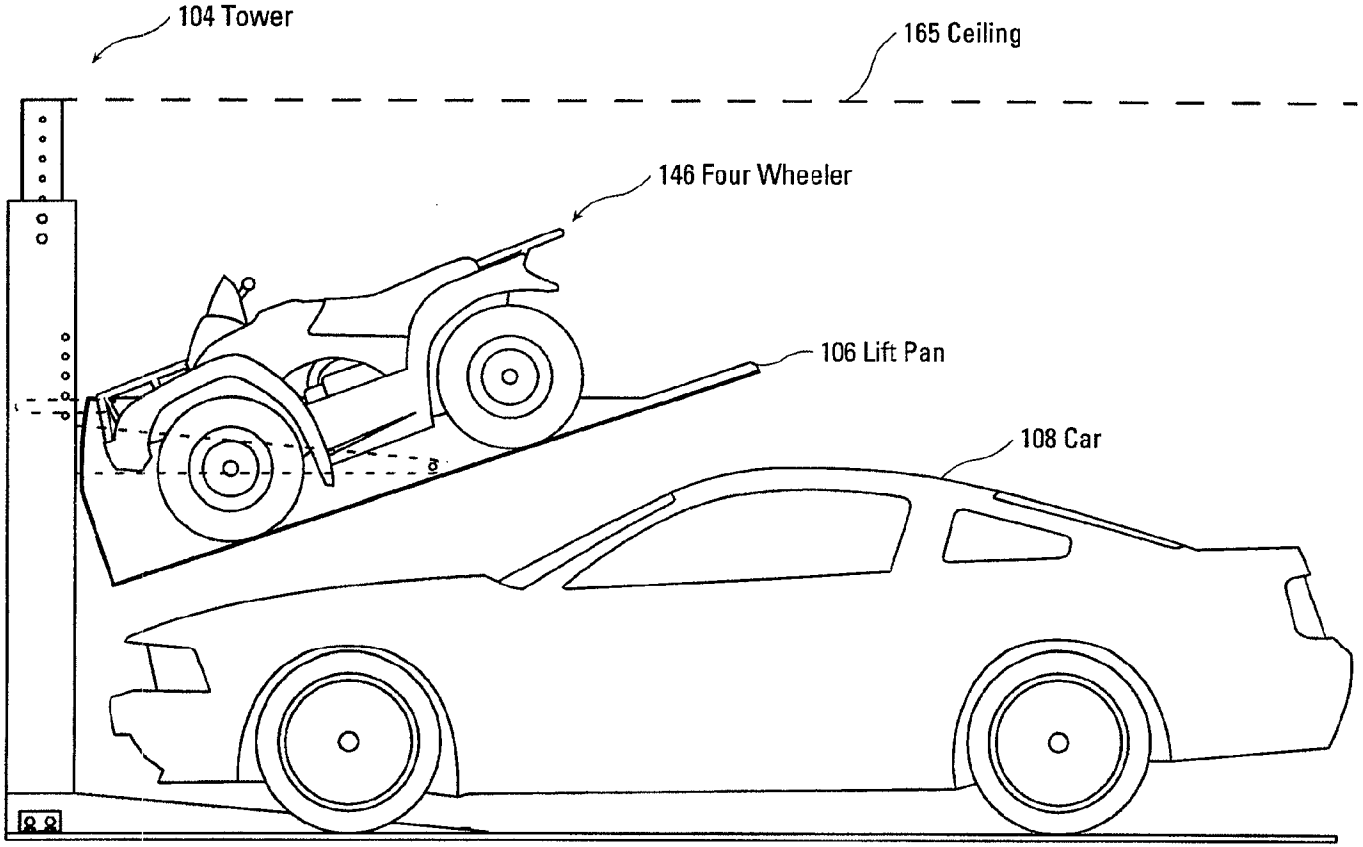
FIG. 6 is a side view of the embodiment of the sporting vehicle lift of FIG. 1 with an ATV lifted over a car.

FIG. 6 is a schematic side view of the embodiment of FIG. 5 with a four wheeler 146 disposed on the lift pan 106. Again, there is plenty of room to fit a four wheeler 146 under a standard height ceiling 165 in a garage over the car 108 because the tilt pan 106 is tilted in a forward direction toward the tower 104.

Figure 7:
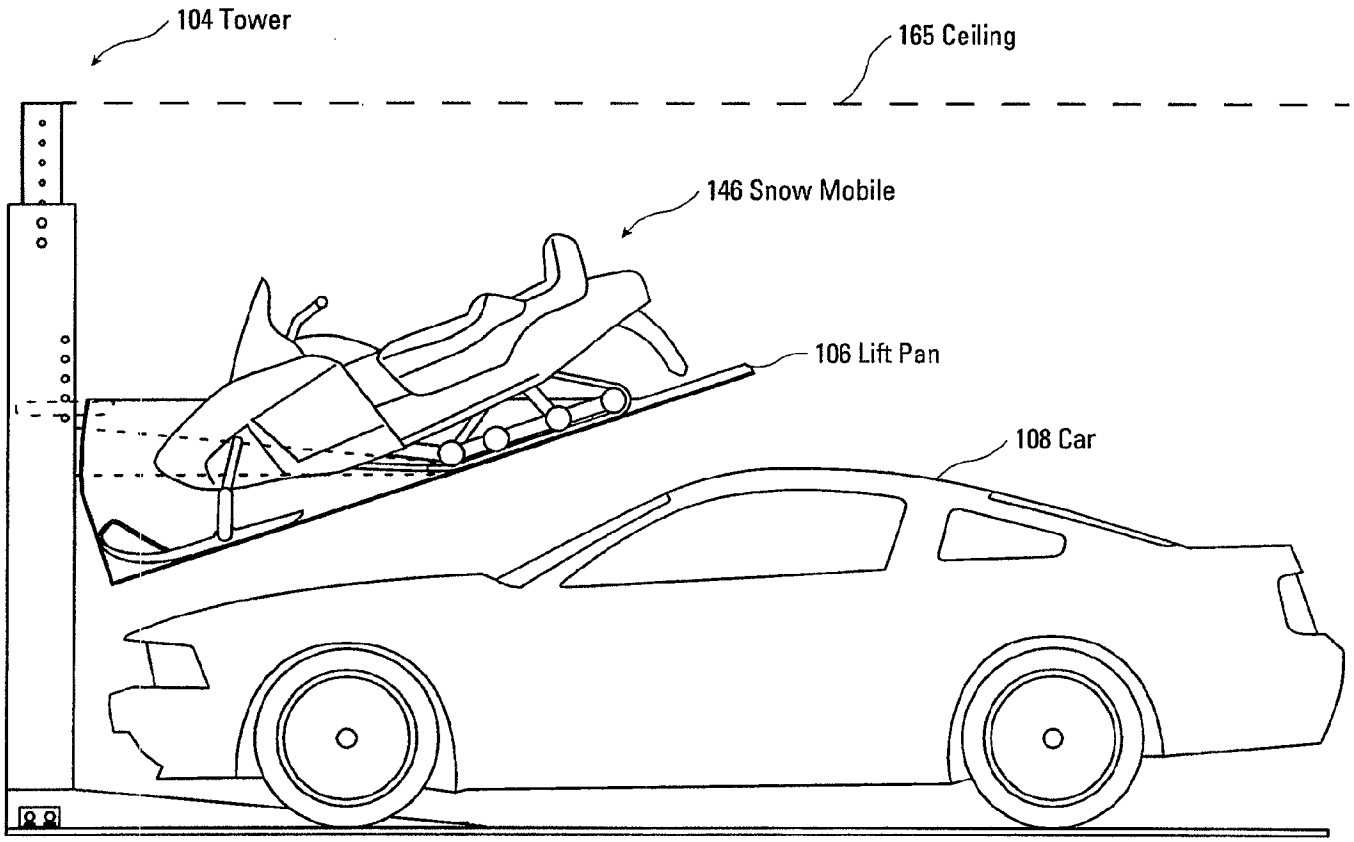
FIG. 7 is a side view of the embodiment of the sporting vehicle lift of FIG. 1 with a snowmobile lifted over a car.

FIG. 7 is a side view of the embodiments of FIGS. 5 and 6 with a snowmobile 146 loaded in lift pan 106. Again, the lift pan 106 is rotated towards the tower 104 which provides room so that the snowmobile 146 can be lifted a sufficient amount to allow the car 108 to fit under the lift pan 106 in a garage space having a standard ceiling height of ceiling 165.

Figure 8:
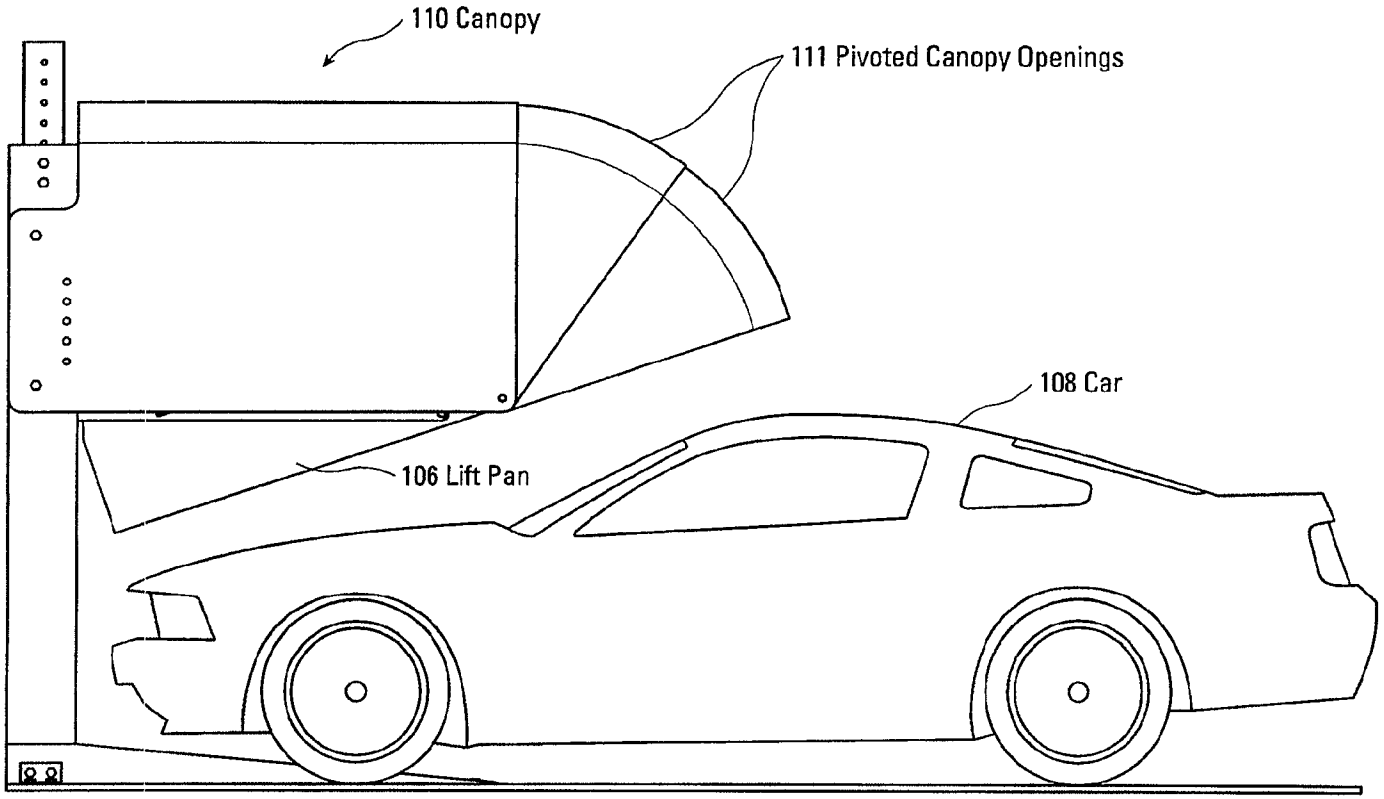
FIG. 8 is a side view of the embodiment of the sporting vehicle lift of FIG. 2 in a raised position with a cover.

FIG. 8 is a side view of an embodiment of the sporting vehicle lift 100 that utilizes a canopy 110. The canopy 110 fits over the lift pan 106 and provides an enclosure for the sporting vehicle 102. The pivoted canopy openings 111 allow the sporting vehicle 102 to be placed under the canopy 110 and removed from the canopy on the lift pan 106.

Figure 9:
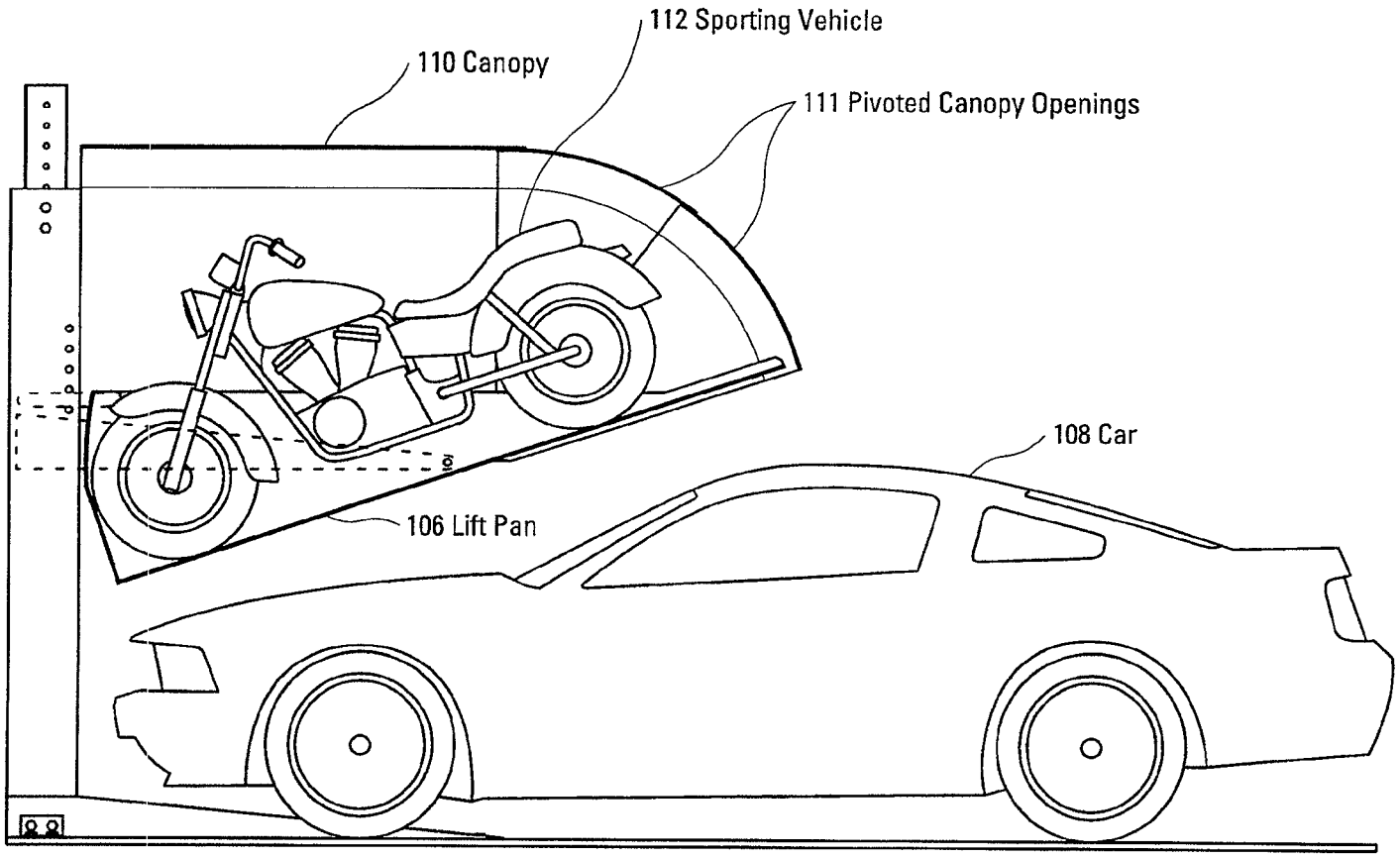
FIG. 9 is a side view of the embodiment of the sporting vehicle of FIG. 2 with the cover in a raised position with a cutaway view of the cover that covers a motorcycle.

FIG. 9 is a side cutaway view illustrating the sporting vehicle 112 loaded on to the lift pan 106 under the cutaway view of the canopy 110. Again, the pivoted canopy openings 111 provide a complete enclosure of the sporting vehicle 112 on the lift pan 106. The pivoted canopy openings 111 extend to the surface of the lift pan 106. Canopy 110 has a top that is horizontally disposed so that the canopy 110 fits within the limited confines of a standard height ceiling. Car 108 fits under the lift pan 106 since the tilt of the lift pan 106 provides sufficient room for the car 108.

Figure 10:
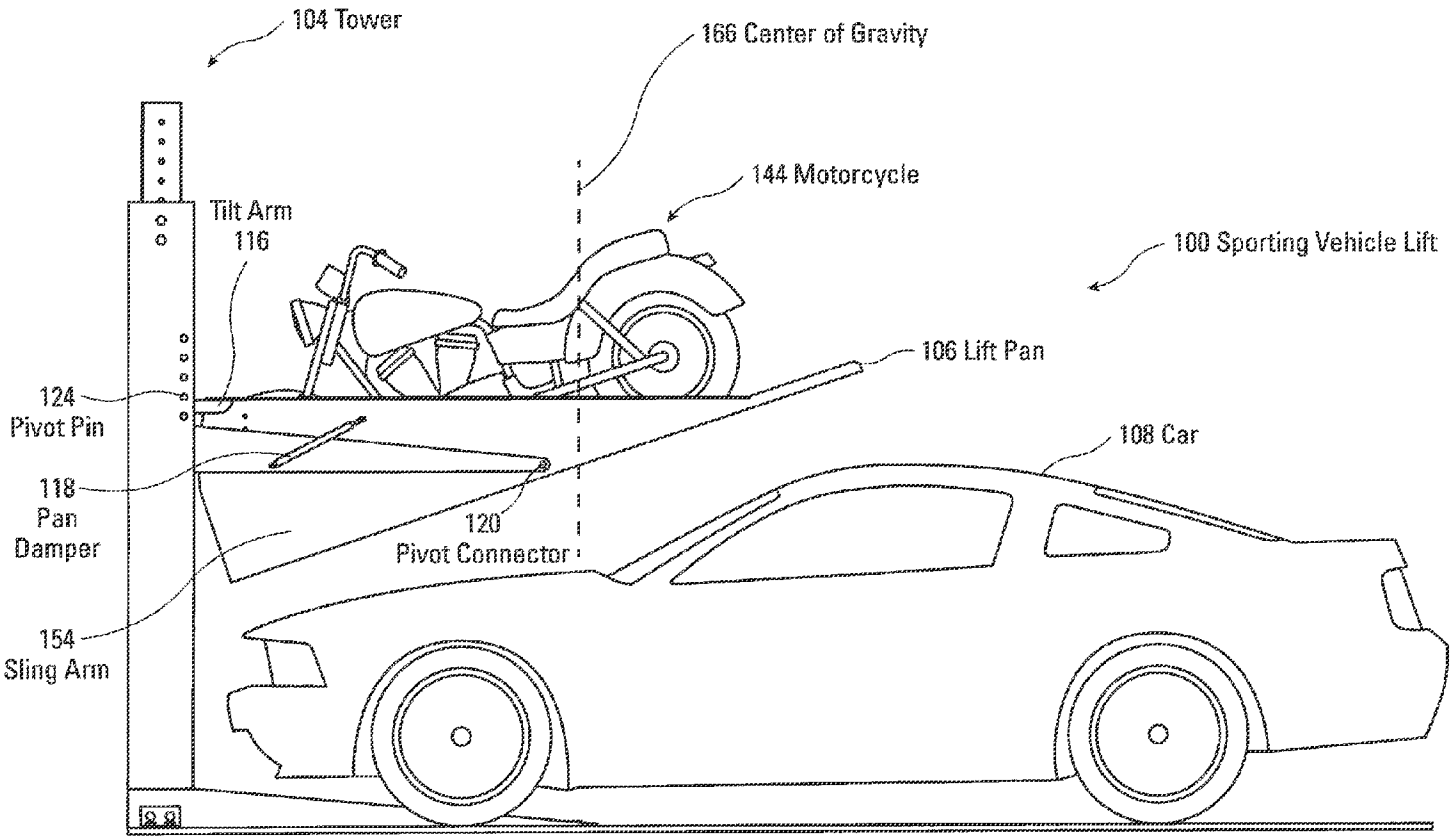
FIG. 10 is a side view of an embodiment of the sporting vehicle lift of FIG. 1 in a raised position over a car.

FIG. 10 is a schematic side view of the sporting vehicle lift 100 in a raised position. Again, the car 108 has a profile that fits under the lift pan 106 which is tilted in a forward direction towards the tower 104. A pan damper 118 is connected to the lift pan 106 and the sling arm 154 to dampen the rotational movement of the lift pan 106 as the lift pan 106 is raised and lowered. As illustrated in FIG. 10, the center of gravity 166 is disposed rearwardly of the pivot connector 120. As also shown in FIG. 10, the tilt arm 116, which is attached to the lift pan 106, engages the pivot pin 124 to ensure that the lift pan 106 rotates towards the tower 104 at pivot connector 120. Since the combined center of gravity of the lift pan 106 and motorcycle 144 is disposed rearwardly of the pivot connector 120 (in a direction away from the tower 104), the pivot pin 124 and the tilt arm 116 will cause the lift pan 106 to rotate counterclockwise towards the tower 104.

Figure 11:
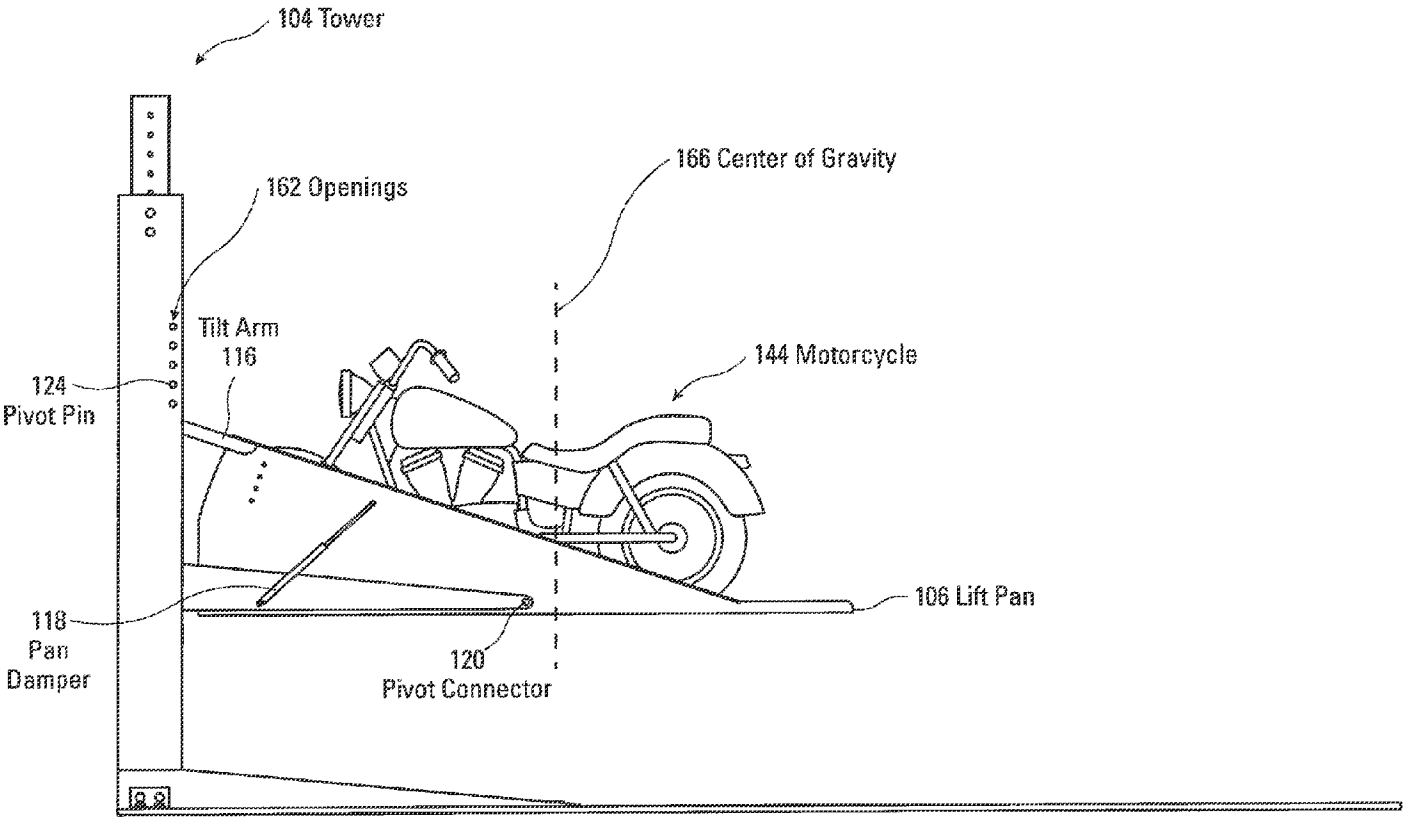
FIG. 11 is a side view of an embodiment of the sporting vehicle lift of FIG. 1 in a partially raised position.

FIG. 11 is an illustration of the embodiment of FIG. 10 with the lift pan 106 partially lowered so that the tilt arm 116 does not engage the pivot pin 124. Since the center of gravity 166 of the combined weight of the motorcycle 144 and the lift pan 106 is rearwardly disposed (to the right of the pivot pin 120 and away from the tower 104), the lift pan 106 has rotated in a clockwise direction. Tower 104 has a number of openings 117 where the pivot pin 124 can be located. The pivot pin 124 should be located so that while the lift pan 106 is being raised, the lift pan 106 will rotate by a sufficient amount so that an angle is created in the bottom of the lift pan that substantially matches the profile of the front portion of the car when the lift pan is in the fully raised position. Pan damper 118 is extended and helps to dampen the movement of the lift pan 106 as the lift pan 106 rotates in a clockwise direction while the lift pan 106 is being lowered.

Figure 12:
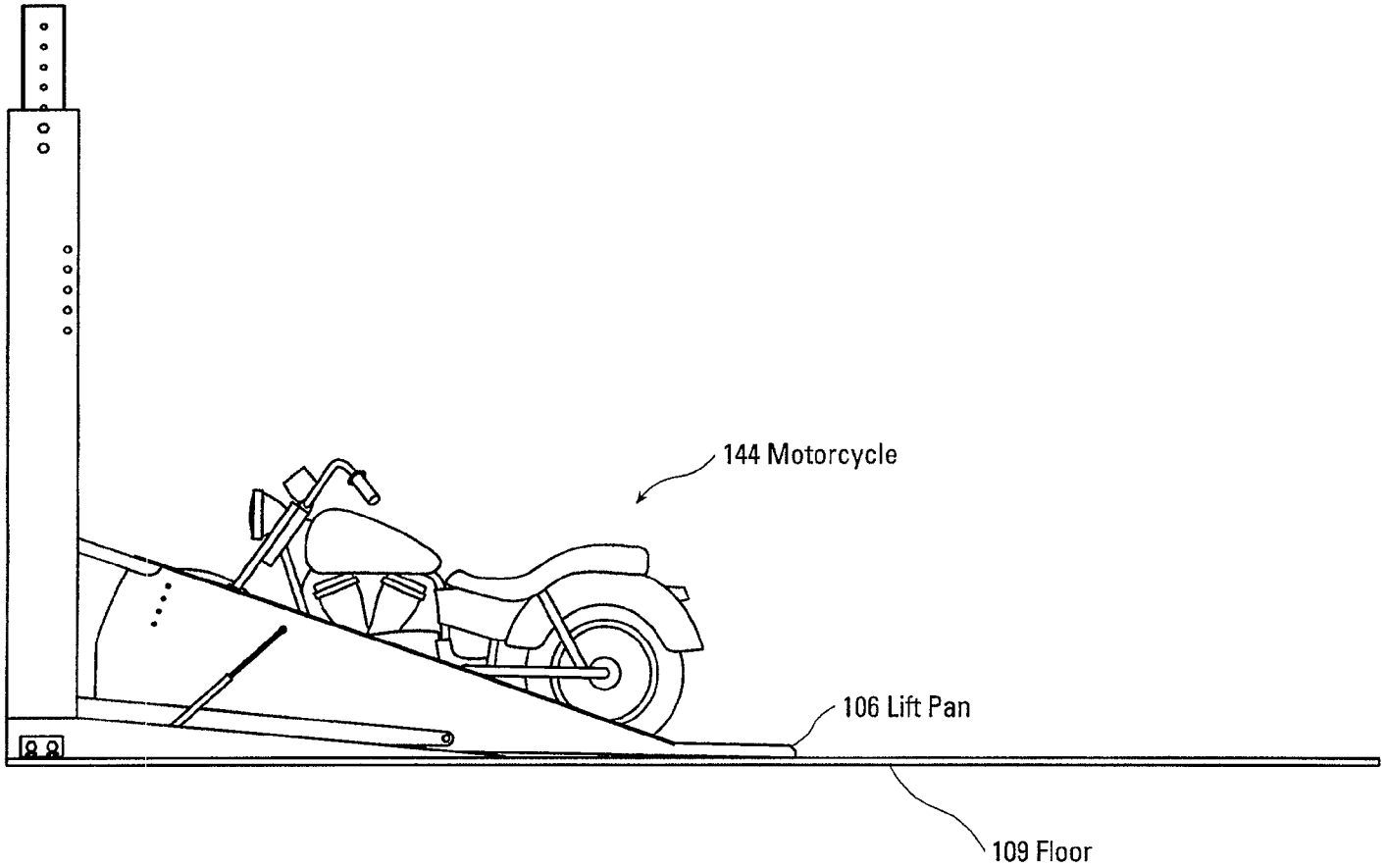
FIG. 12 is a side view of an embodiment of the sporting vehicle lift of FIG. 1 in a lowered position.

FIG. 12 is a schematic side view of the lift pan 106 lowered all the way to the floor 109. The motorcycle 144 can then be removed from the lift pan 106 onto the floor 109. The bottom of the lift pan 106 is horizontally disposed so that the lift pan 106 sits flat on the floor 109.

Figure 13:
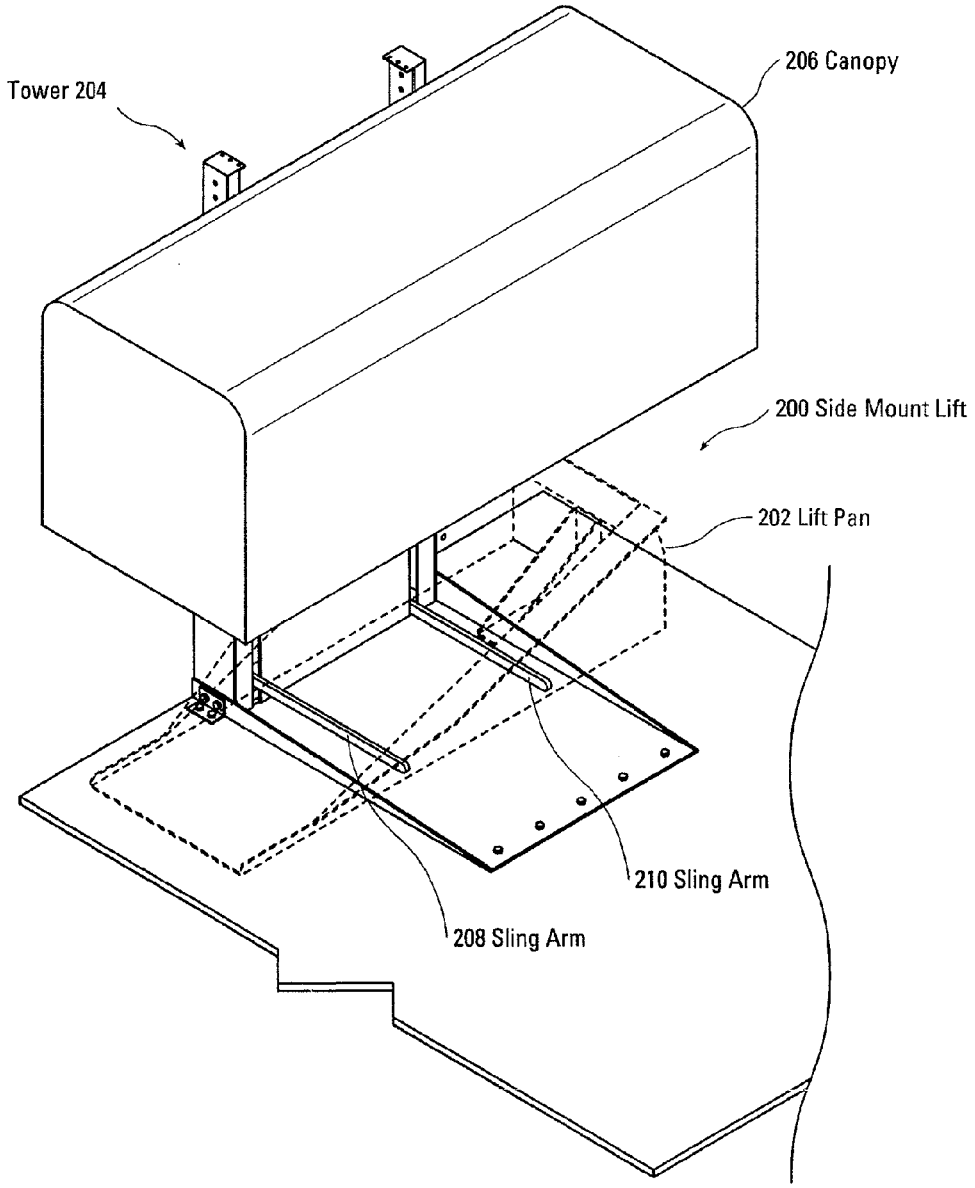
FIG. 13 is an isometric view of an embodiment of a side lift.

FIG. 13 is an isometric view of another embodiment comprising a side mount lift 200. As shown in FIG. 13, the tower 204 is mounted on a sidewall of a garage or other structure. The lift pan 202 is raised and lowered by sling arms 208, 210. The lift pan 202 moves up and into the canopy 206 for protection of the sporting vehicle (not shown).

The various embodiments therefore show a sporting vehicle lift 100 that has a lift pan 106 that tilts towards a lifting tower when the sporting vehicle lift is raised. The tilting of the lift pan 106 occurs either automatically because the center of gravity of the lift pan 106 in the sporting vehicle 102 is forward of the pivot pins 120, 122, or because a tilt arm 116 that is connected to the lift pan 106 engages a pivot pin 124 causing the lift pan to rotate towards the lift tower 104. The tilting of the lift pan 106 allows a car 108 to fit under the lift pan 106 so that the lift pan 106 and the sporting vehicle 102 do not have to be raised by an extended amount that would otherwise be required if the lift pan 106 was not tilted towards the lift tower 104. This allows the sporting vehicle lift 100 to be utilized in garages, or other storage areas with a standard or low ceiling height, while accommodating both the sporting vehicle 102 and the car 108.

What is claimed is:

1. A method of storing a sporting vehicle on a lift pan above a car comprising:

placing said sporting vehicle on a lift pan;

connecting a tower to tower legs that extend on a floor under said lift pan and function as a cantilever to assist in supporting said tower in an upright position;

connecting a lift shaft to said tower;

coupling a sling to said lift shaft, said sling having sling arms and a sling cross bracket;

attaching said lift pan to said sling arms using pivot connectors that cause said lift pan to automatically pivot with respect to said sling towards said tower when the combined weight of said lift pan and said sporting vehicle has a center of gravity that is located between said tower and said pivot connectors;

raising said sling and said lift pan so that said lift pan automatically pivots on said pivot connectors towards said tower when said center of gravity of said combined weight of said sporting vehicle and said lift pan being located between said tower and said pivot connectors;

engaging said lift pan with said sling arms to limit the amount said lift pan can pivot on said pivot connectors, so that said lift pan pivots to an angle that allows said car to fit under said lift pan.

2. The method of claim 1 further comprising:

engaging a pivot pin on said tower with a tilt arm attached to said lift pan to secure said lift pan at said angle that allows said car to fit under said lift pan.

3. The method of claim 1 wherein said step of raising said sling arms comprises:

rotating said lift shaft with a motor, said lift shaft coupled to a threaded receiver bracket that is coupled to said sling cross bracket.

4. The method of claim 1 further comprising:

placing a canopy over said lift pan which covers said sporting vehicle.

5. A sporting vehicle lift for raising and storing a sporting vehicle above a car comprising:

a tower disposed on a floor surface;

a sling disposed on said tower having a sling cross bracket and at least two sling arms that extend outwardly from said tower;

pivot connectors disposed on each of said sling arms;

a threaded shaft disposed in said tower that is coupled to said sling cross bracket;

a motor that rotates said threaded shaft which causes said sling to move up and down on said tower;

tower legs that extend outwardly from said tower in a direction that is substantially parallel to said sling arms and function as a cantilever to hold said tower in a substantially vertical position;

a lift pan that is coupled to said sling arms with pivot connectors, said pivot connectors located on said lift pan so that said lift pan automatically pivots towards said tower when said sling is raised and when the center of gravity of the combined weight of said sporting vehicle and said lift pan is located between said pivot connectors and said tower, and so that a bottom surface of said lift pan is tilted by an amount that allows said car to fit below said lift pan;

a pivot pin disposed on said tower that engages said lift pan so that said bottom surface of said lift pan remains tilted by an amount that allows said car to fit below said lift pan.

6. A sporting vehicle lift for raising and storing a sporting vehicle above a car comprising:

a tower disposed on a floor surface;

a sling disposed on said tower having a sling cross bracket and at least two sling arms that extend outwardly from said tower;

pivot connectors disposed on each of said sling arms;

a threaded shaft disposed in said tower that is coupled to said sling cross bracket;

a motor that rotates said threaded shaft which causes said sling to move up and down in said tower;

tower legs that extend outwardly from said tower in a direction that is substantially parallel to said sling arms and function as a cantilever to hold said tower in a substantially vertical position;

a lift pan that is coupled to said sling arms with pivot connectors, said pivot connectors located on said lift pan so that said lift pan does not automatically pivot towards said tower when said sling is raised and when the center of gravity of the combined weight of said sporting vehicle and said lift pan is not located between said pivot connectors and said tower;

a pivot pin disposed on said tower that engages said lift pan and causes said lift pan to pivot when said lift pan is being raised so that a bottom surface of said lift pan is tilted by an amount that allows said car to fit below said lift pan.

7. The sporting lift of claim 6 further comprising:

a canopy disposed over said lift pan to protect said sporting vehicle.

8. The sporting lift of claim 6 wherein said car is disposed under said lift pan and said tower is in front of said car.

9. The sporting lift of claim 6 wherein said car is disposed under said lift pan and said tower is to the side of said car.

10. The sporting lift of claim 6 wherein said tower has openings where said pivot pin can be disposed so that said amount that said lift pan is tilted can be adjusted by placement of said pivot pin in said tower.

11. A method of making a sporting vehicle lift for storing a sporting vehicle above a car comprising:

attaching a sling having sling arms to a tower, said sling disposed to move vertically on said tower;

coupling a lift shaft to said tower that engages said sling to move said sling vertically on said tower;

coupling a motor to said lift shaft that moves said lift shaft and causes said sling to move vertically on said tower;

attaching a lift pan to said sling arms of said sling using pivot connectors that are located on said lift pan so that said lift pan and said sporting vehicle disposed on said lift pan automatically pivot toward said tower when said sling moves vertically upward on said tower and when a combined center of gravity of said lift pan and said sporting vehicle is located between said tower and said pivot connectors.

12. The method of claim 11 further comprising:

engaging a pivot pin on said tower so that said pivot pin engages said lift pan and secures said lift pan at an angle that allows said car to fit under said lift pan.

13. The method of claim 11 wherein said process of said lift pan engaging said lift pin further comprises:

causing a tilt arm disposed on said lift pan to engage said lift pin to cause said lift pan to pivot toward said tower.

14. A method of making a sporting vehicle lift for storing a sport vehicle above a car comprising:

attaching a sling having sling arms to a tower, said sling disposed to move vertically on said tower;

coupling a lift shaft to said tower that engages said sling to move said sling vertically on said tower;

coupling a motor to said lift shaft that moves said lift shaft and causes said sling to move vertically on said tower;

attaching a lift pan to said sling arms using pivot connectors that are located on said lift pan so that said lift pan and said sporting vehicle disposed on said lift pan do not pivot towards said tower when said sling moves vertically upward on said tower and when a combined center of gravity of said lift pan and said sporting vehicle is located behind said pivot connectors;

placing a pivot pin on said lift tower so that said lift pan engages said lift pin as said sling is moved vertically upward on said tower and causes said lift pan to pivot on said pivot connectors towards said tower so that said lift pan is tilted by an amount that allows said car to fit below said lift pan.

* * * * *